US006042099A

United States Patent [19]

Takagishi

[11] Patent Number: 6,042,099

[45] Date of Patent: Mar. 28, 2000

[54] SHEET FEEDING APPARATUS

[75] Inventor: Hiroaki Takagishi, Tokyo, Japan

[73] Assignee: Canon Kabushiki Kaisha, Tokyo, Japan

[21] Appl. No.: 08/958,528

[22] Filed: Oct. 27, 1997

[30] Foreign Application Priority Data

Oct. 30, 1996 [JP] Japan ..... 8-287758
Jan. 20, 1997 [JP] Japan ..... 9-007384

[51] Int. Cl.[7] ..... B65H 5/00

[52] U.S. Cl. ..... 271/2; 271/114; 271/118; 271/122

[58] Field of Search ..... 271/2, 114, 118, 271/122, 127, 145, 9.06, 110

[56] References Cited

U.S. PATENT DOCUMENTS 5,172,899 12/1992 Tajima ..... 271/122
5,462,267 10/1995 Hori ..... 271/118
5,501,444 3/1996 Yukimachi et al. ..... 271/127
5,775,686 7/1998 Miyake ..... 271/127
5,860,645 1/1999 Tomura et al. ..... 271/114
5,882,002 3/1999 Kamei et al. ..... 271/118

*Primary Examiner*—H. Grant Skaggs
*Attorney, Agent, or Firm*—Fitzpatrick, Cella, Harper & Scinto

[57] ABSTRACT

A sheet feeding apparatus capable of separating and feeding sheets each having a flap like an envelope. In the sheet feeding apparatus, when stacked sheets are delivered by a pickup roller supported liftably, and separated one by one by a feed roller for rotating in a sheet feed direction and a retard roller for rotating in an opposite direction to the sheet feeding direction, the pickup roller is moved up and down a plurality of times until a flap of the delivered sheet passes between the feed roller and the retard roller, which makes it possible to prevent buckling of the sheet.

16 Claims, 18 Drawing Sheets

SHEET FEEDING APPARATUS

BACKGROUND OF THE INVENTION

1. Field of the Invention

The present invention relates to a sheet feeding apparatus for use in an image forming apparatus such as a copying machine or a printer, and an image forming apparatus using the sheet feeding apparatus, and more particularly, to a sheet feeding apparatus which is able to stably feed even envelopes.

2. Description of the Related Art

In automatic sheet feeding for conventional copying machines and printers, a stack of sheets is fed and separated one by one by a delivery roller or the like.

Various types of sheet separation methods have been proposed. One of the proposed methods adopts a retard separation mechanism composed of a feed roller for rotating in a direction to feed sheets and a retard roller for rotating in a reverse direction to return the sheets.

Although a popular type of printer separates and feeds cut sheets of so-called plain paper one by one and records images thereon, the number of printers, which are able to separate and feed a plurality of envelopes as sheets, one by one, and to automatically print the names of addressees and senders, has increased in recent years.

However, envelopes are provided with a sealing flap as distinct from cut sheets, and two sheets lie one over the other at the flap of a single envelope. Therefore, in separation of the envelope particularly by the retard separation mechanism, the retard separation mechanism performs a separating operation at the flap of the envelope, which sometimes buckles the leading end of the envelope and causes sheet jam.

SUMMARY OF THE INVENTION

The present invention has been made in order to solve the above problem and has, as an object, the provision of a sheet feeding apparatus capable of stably separating and feeding even a sheet like an envelope that has a flap, and an image forming apparatus using the sheet feeding apparatus.

In order to achieve the above object, according to one aspect of the invention, there is provided a sheet feeding apparatus comprising a sheet support means for supporting a sheet, a pickup rotating means for feeding out the sheet supported by the sheet support means, a separation means for sequentially separating the sheet fed out by the pickup rotating means, the separation means having a feed rotating means for rotating in a direction to advance the sheet and a retard rotating means, located opposed to the feed rotating means, for rotating in a direction to return the sheet, and a control means for controlling the sheet feeding amount of the pickup rotating means in accordance with the type of the sheet to be fed.

According to another aspect of the invention, there is provided a sheet feeding apparatus comprising a sheet support means for supporting a sheet, a pickup rotating means for feeding out the sheet supported by the sheet support means, a separation means for sequentially separating the sheet fed out by the pickup rotating means, the separation means having a feed rotating means for rotating in a direction to advance the sheet and a retard rotating means, located opposed to the feed rotating means, for rotating in a direction to return the sheet, a pickup shift means for shifting the pickup rotating means between a position to deliver the sheet in contact therewith and a position apart from the sheet, a pickup control means for controlling the pickup shift means so that the pickup rotating means repeats, a plurality of times, a contacting and separating operation with respect to one sheet to be delivered, and a drive control means for transmitting the drive to the separation means when the pickup rotating means is feeding the sheet in contact therewith, during the repetitive contacting and separating operation thereof with respect to one sheet under the control of the pickup control means, and interrupting the transmission of the drive to the separation means when the pickup rotating means is apart from the sheet.

DESCRIPTION OF THE PREFERRED EMBODIMENTS

A sheet feeding apparatus and an image forming apparatus according to the preferred embodiments of the present invention will be described in detail with reference to the attached drawings.

Figure 1:
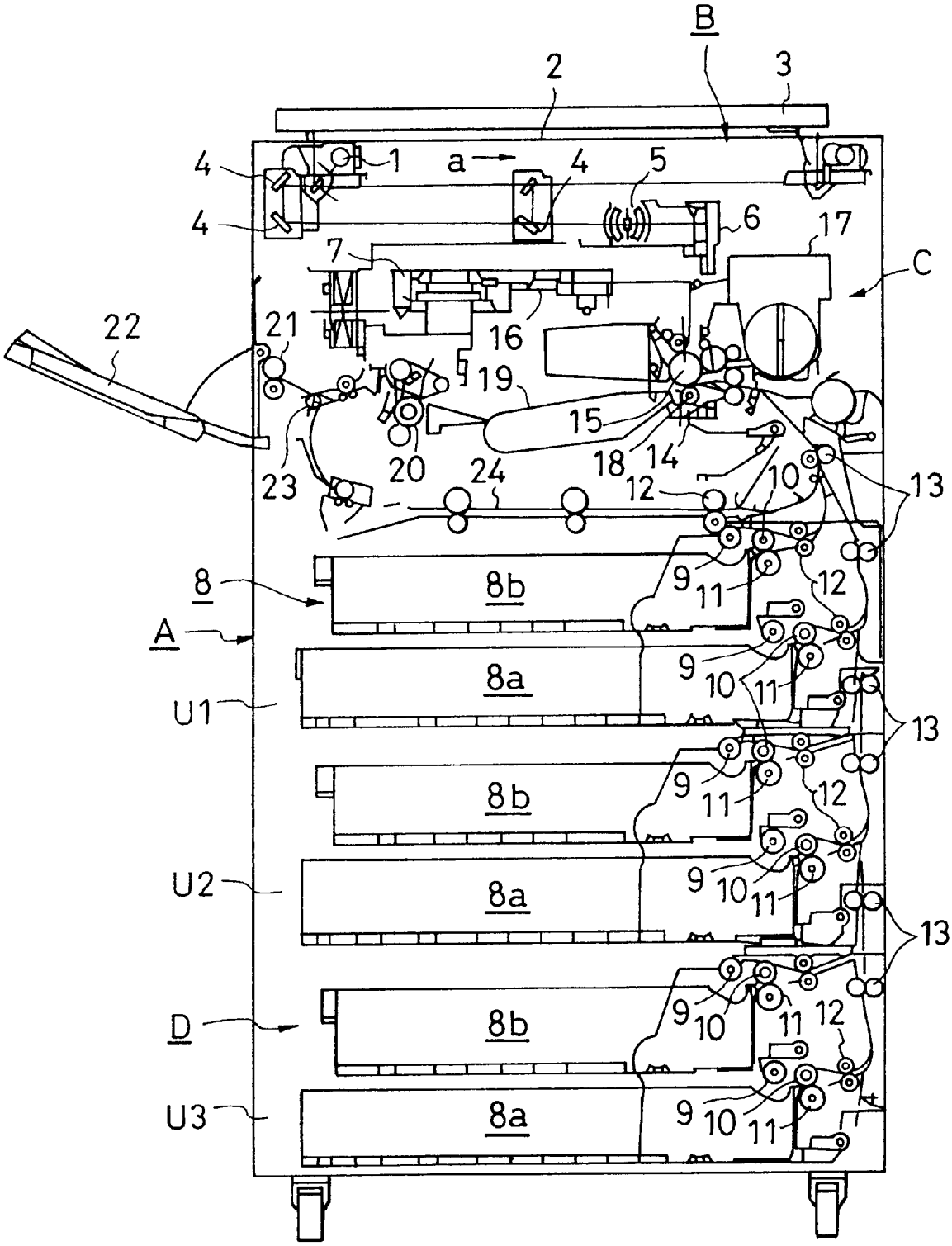
FIG. 1 is a view showing the overall configuration of an image forming apparatus using a sheet feeding apparatus according to the present invention.
Figure 2:
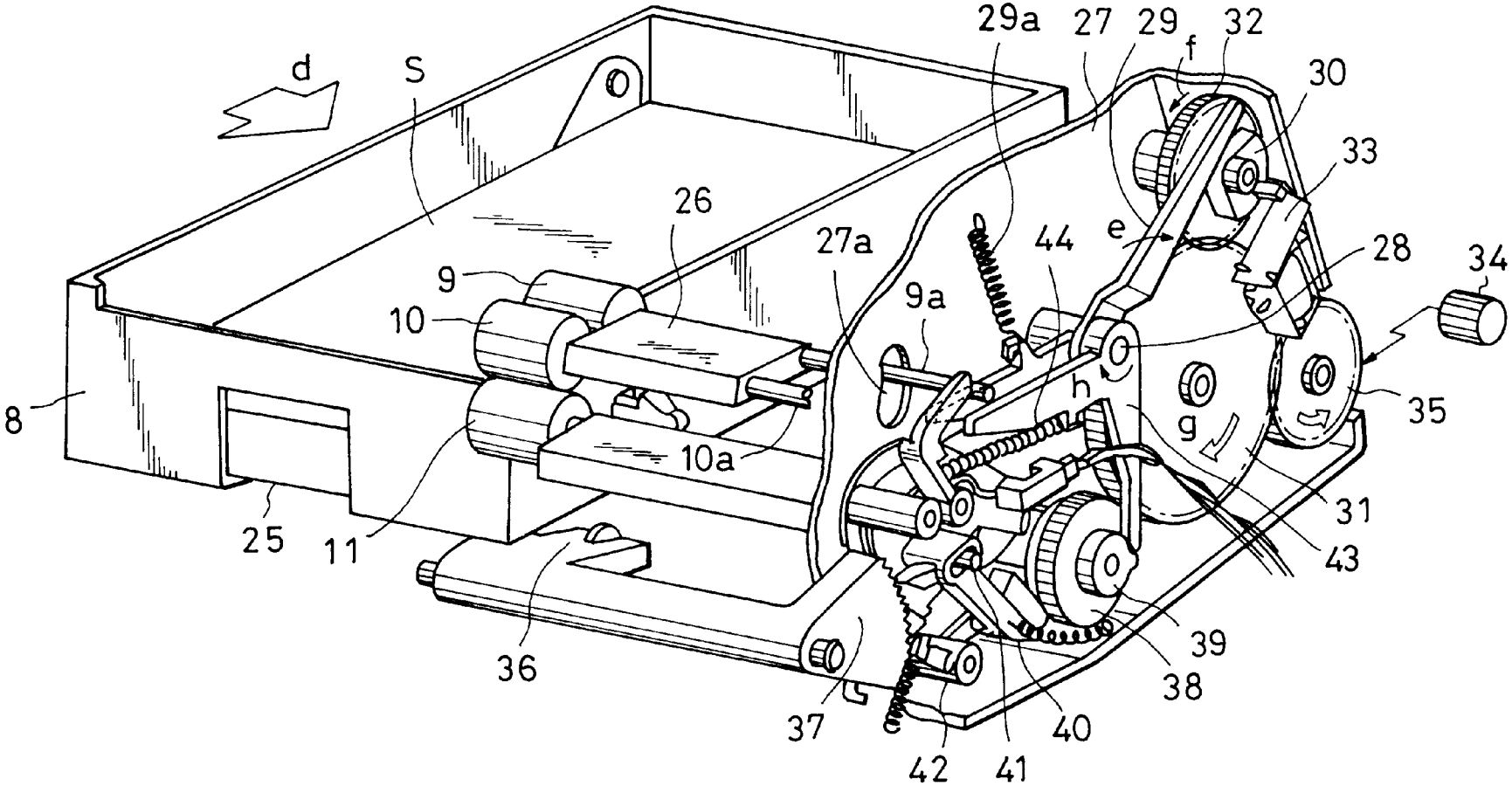
FIG. 2 is a structural view of the sheet feeding apparatus.
Figure 3:
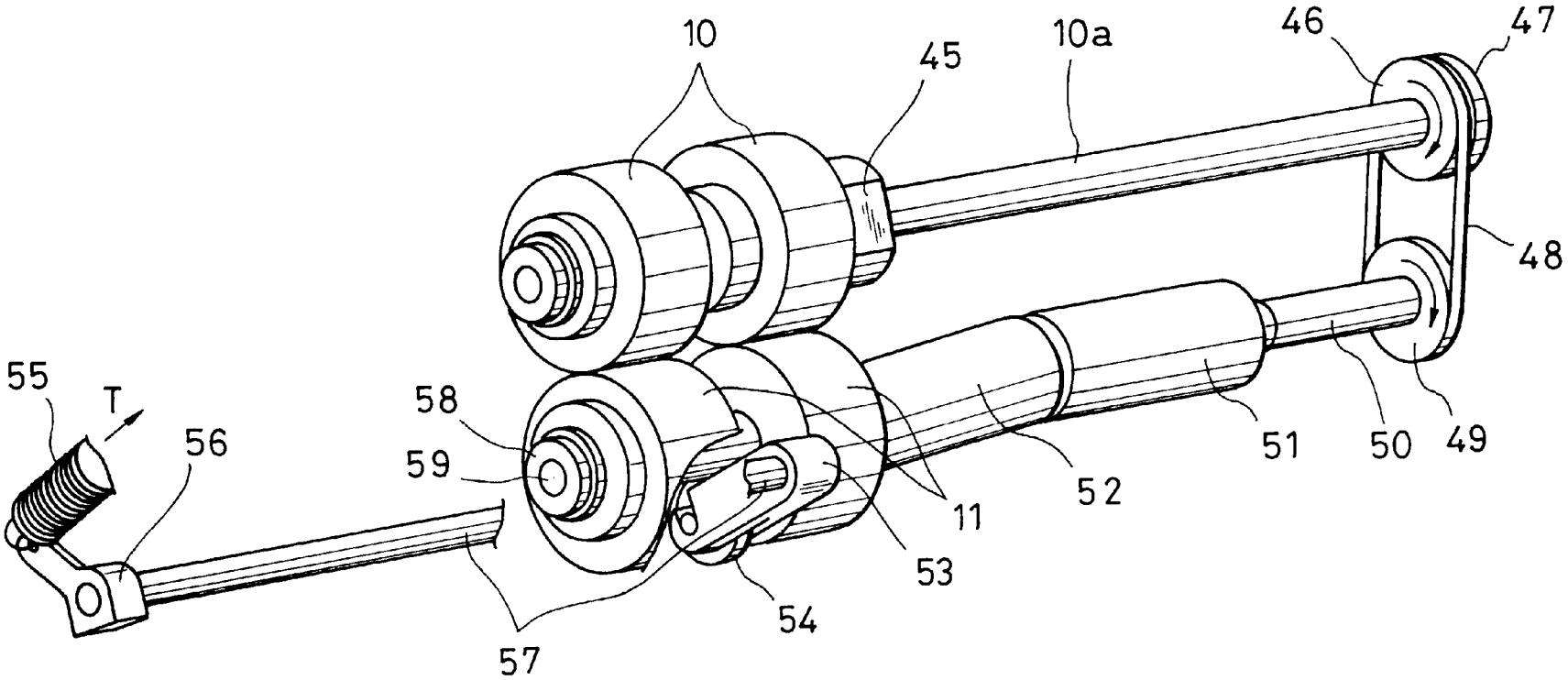
FIG. 3 is a structural view of a separation means.
Figure 5:
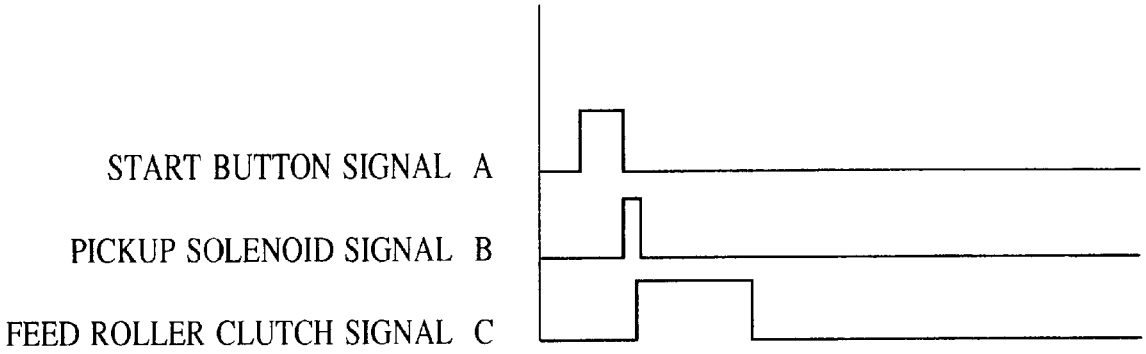
FIG. 5 is a chart explaining signals for use in moving a pickup roller up and down.
Figure 6:
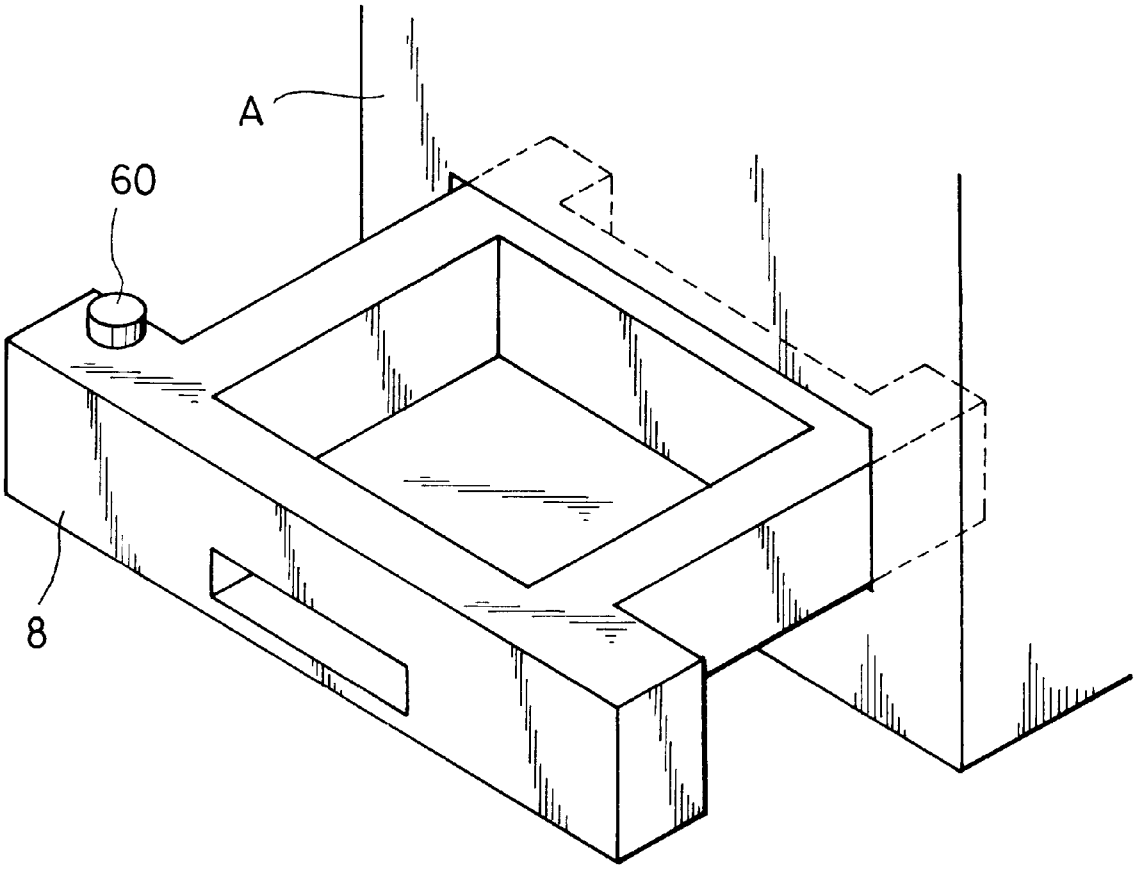
FIG. 6 is a perspective view of a cassette provided with a sheet type setting dial.
Figure 11A:
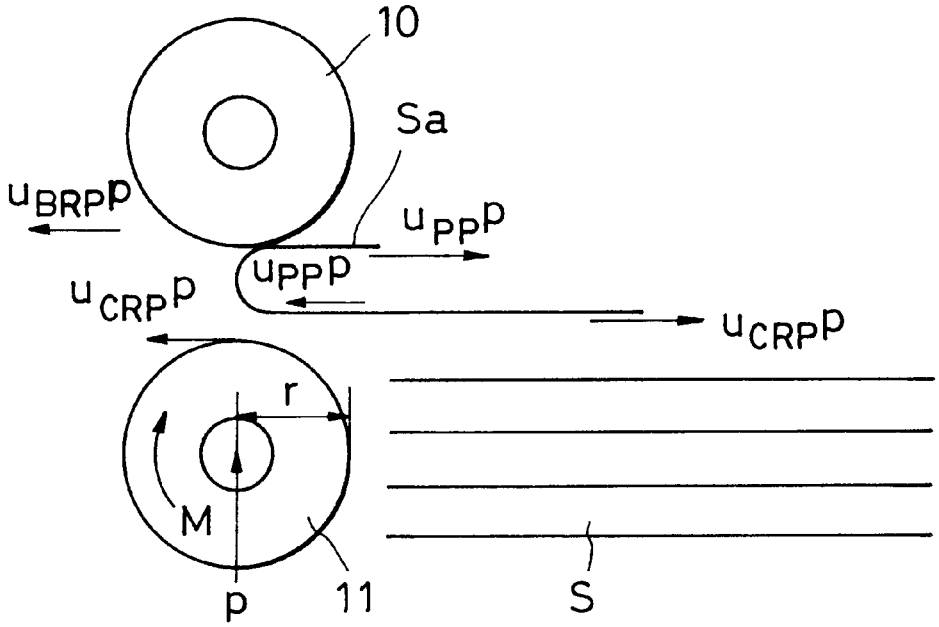
FIGS. 11A and 11B are views explaining the frictional force between the separation means and an envelope in an envelope feeding operation.
Figure 11B:
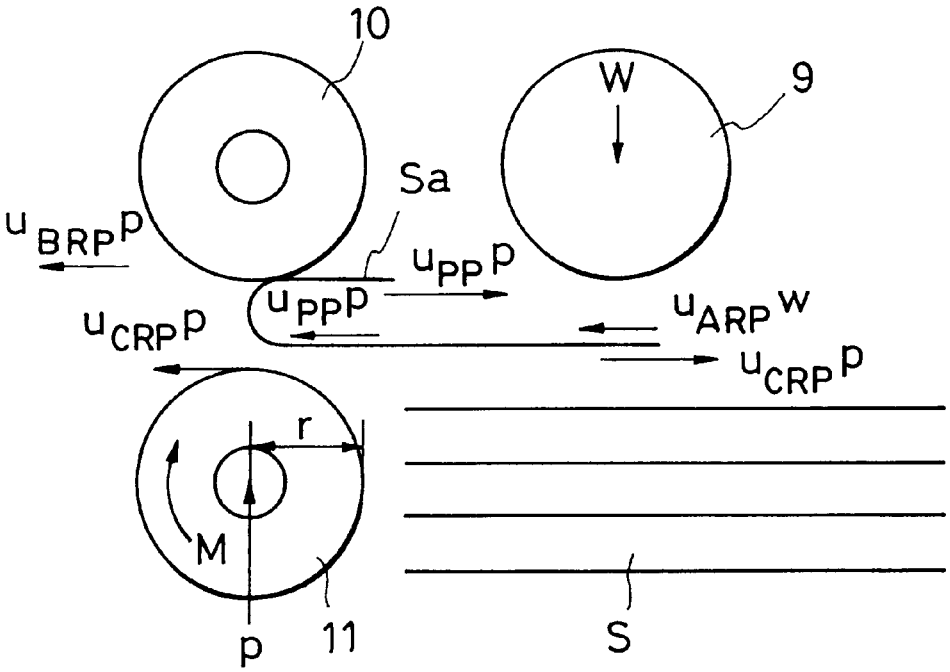
Figure 12:
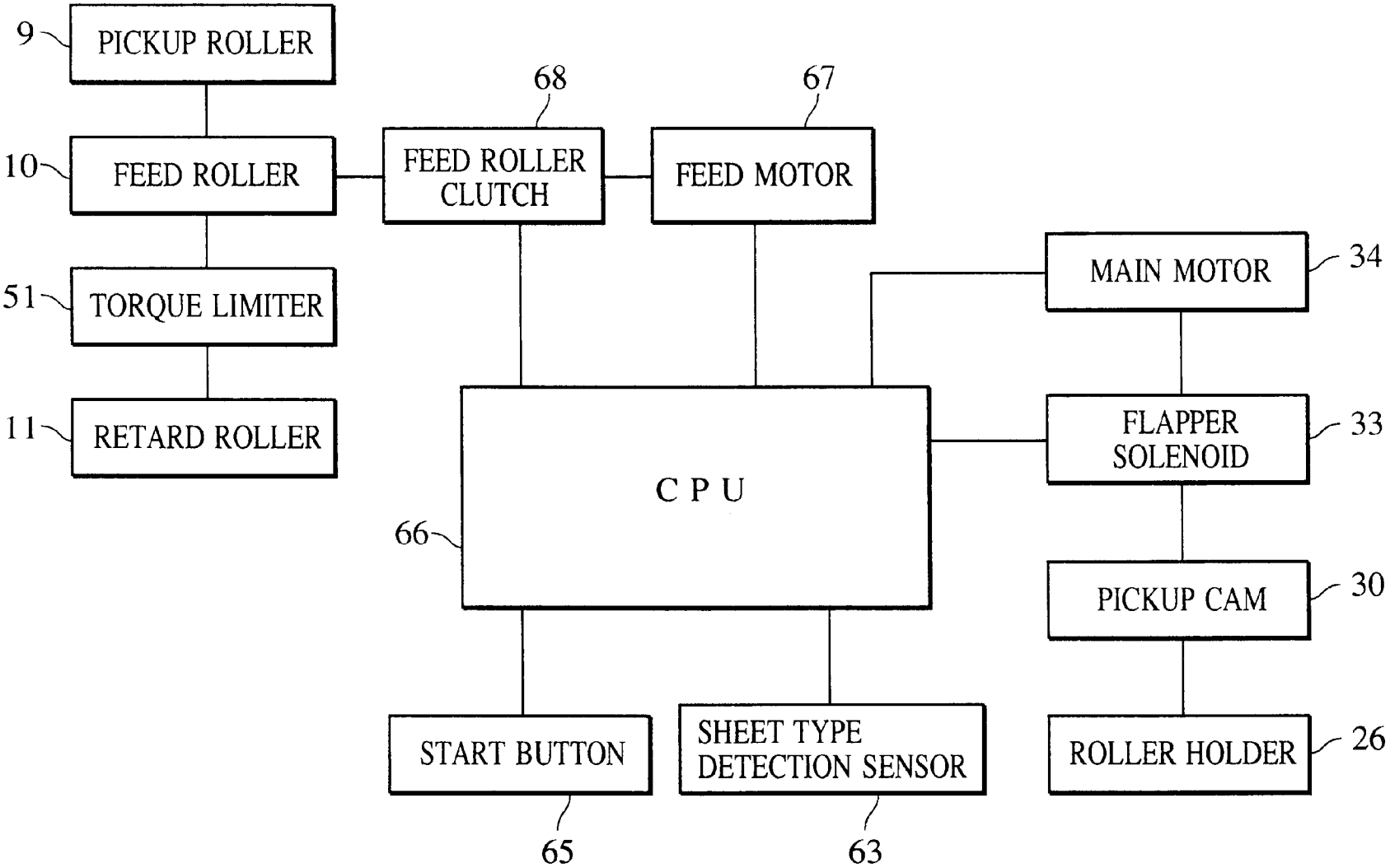
FIG. 12 is a block diagram of a drive control means.

An embodiment of the present invention will be described with reference to FIGS. 1 to 12. FIG. 1 is a view showing the overall configuration of an image forming apparatus using a sheet feeding apparatus according to the present invention, FIG. 2 is a structural view of the sheet feeding apparatus, FIG. 3 is a structural view of a separation means, FIG. 4 is a view explaining the frictional force between the separation means and a plain sheet in a sheet feeding operation, FIG. 5 is a chart explaining signals for use in moving a pickup roller up and down, FIGS. 6 to 8 are structural views of a sheet type setting means, FIG. 9 is an explanatory view of a touch panel for use in entering the length of a flap and the like, FIGS. 10 and 11 are views explaining the frictional force between the separation means and an envelope in an envelope feeding operation, and FIG. 12 is a block diagram of a drive control means.

The overall configuration of the image forming apparatus will be first described, and then, the configuration of the sheet feeding apparatus will be described.

[General Description of Image Forming Apparatus]

Referring to FIG. 1, a main body A of the image forming apparatus comprises a scanner section B serving as an image reading means for reading information about images on a document, an image forming section C serving as an image forming means, and a sheet feeding apparatus D assembled thereunder, which are arranged in this order from the top thereof.

The scanner section B comprises a scanning light source 1, a platen glass 2, a document cover 3 hinged to the apparatus body A, mirrors 4, a lens 5, a photoreceptor (photoelectric conversion device) 6 and an image processor. First, a document such as a book, cardboard or curled paper, or a sheet document is laid on the platen glass 2 with its image side down, the rear side of the document is pressed by the cover 3, and the document is thereby set in a stationary state. When a reading start key is pressed, the scanning light source 1 scans below the platen glass 2 in the direction of the arrow a in FIG. 1, and reads information about images on the document plane. The document image information read by the scanning light source 1 is processed and converted into electric signals by the image processor, and transmitted to a laser scanner 7 serving as an optical system.

The image forming apparatus main body A functions as a copying machine when the signals processed by the image processor are input to the laser scanner 7, and functions as a printer when output signals from a personal computer are input to the laser scanner 7. Moreover, when signals sent from a separate facsimile are input or processed signals of the image processor are transmitted to a separate facsimile, the image forming apparatus body A functions a facsimile.

On the other hand, sheet cassettes 8 are loaded below the image forming section C. A lower cassette 8*a* and an upper cassette 8*b* constitute one sheet feeding unit. In this embodiment, three sheet feeding units U1, U2 and U3 composed of six cassettes are loaded. The sheet feeding unit U1 placed at an upper position is detachably mounted in the apparatus body 1, and the two sheet feeding units U2 and U3, which are placed at a lower position, are detachably mounted in the sheet feeding apparatus D.

Sheets contained in the cassettes 8*a* and 8*b* are delivered one by one by a pickup roller 9 serving as a feeding rotator, which will be described below, separated and advanced one by one by the cooperative action of a feed roller (a rotator for rotating in a direction to advance the sheet) 10 and a retard roller (a rotator for rotating in a direction to return the sheet) 11, which constitute a separation means, transported by transport rollers 12 and 13 constituting a transport means, guided to a register roller 14, and supplied to the image forming section C by the register roller 14 in synchronization with an image forming operation.

The image forming section C comprises a photoelectric photoconductive drum 15, an image writing optical system 16, a developing device 17, a transfer charger 18 and the like. Laser light output from the laser scanner 7 corresponding to image information is scanned onto the surface of the photoconductive drum 15 which is uniformly charged by a charger, thereby forming a latent image. A toner image is formed by supplying the latent image with toner from the developing device 17, and transferred onto the first plane of the sheet, which has been transported by the register roller 14 in synchronization with the rotation of the photoconductive drum 15, by the transfer charger 18.

In FIG. 1, a conveyor belt 19 conveys the sheet having the toner image formed thereon, and numerals 20 and 21 respectively denote a fixing device and an eject roller. The sheet with the toner image is conveyed to the fixing device 20 by the conveyor belt 19, and heated and pressed, whereby the toner image is fixed on the surface of the sheet. After that, the sheet is ejected by the eject roller 21 and put onto a tray 22 which is located outside the main body A.

In recording images on both sides of the sheet, the eject roller 21 catches the sheet ejected from the fixing device 20, and rotates reversely when the rear end of the sheet passes through a junction 23, and the sheet is put on a refeeding path 24. Then, the sheet is transported by the transport rollers 12 and 13, and brought to the register roller 14. After images are formed on the second plane of the inverted sheet in a similar manner to above, the sheet is ejected and put onto the tray 22.

[Sheet feeding apparatus]

Next, the sheet feeding apparatus D will be described. The sheet feeding apparatus D delivers one by one sheets loaded in the sheet cassette 8 by using the pickup rotating means, and separates and feeds the sheets by using the separation means.

The pickup rotating means is composed of the up-and-down pickup roller 9 which is in the up position at the non-feeding time and rotates in the down position at the sheet feeding time.

The structure of the up-and-down pickup roller 9 and the structure of a lifter, which lifts the sheets contained in the cassette 8 to a delivery position in correlation to the movements of the pickup roller 9, will be described through the case of plain sheet feeding.

Referring to FIG. 2, sheets S are stacked on a sheet stack plate 25 which is turnably mounted at the bottom of the cassette 8, and the cassette 8 is able to be loaded into the apparatus body A from the direction of the arrow d.

The sheets S in the cassette 8 are fed out from the top by the pickup roller 9, and separated and fed one by one by the action of the feed roller 10 and the retard roller 11.

A roller shaft 9*a* of the pickup roller 9 and a roller shaft 10*a* of the feed roller 10 are connectingly supported by a roller holder 26, and the pickup roller 9 is supported movably around the feed roller 10 and urged toward the sheet plane by a spring (not shown).

One end of the pickup roller shaft 9*a* reaches a lifter mechanism through a slot 27*a* which is formed on a feed frame 27. A lift lever 29 is turnably mounted on a shaft 28 integrally formed with the feed frame 27, and urged by a spring 29*a* in the clockwise direction (the direction of the arrow e in FIG. 2).

Therefore, one end of the lift lever 29 is in contact with the pickup roller shaft 9*a*. The other end of the lift lever 29 reaches near a pickup cam 30, and the lift lever 29 rocks in correlation to the turn of the pickup cam 30.

The pickup cam 30 is coaxially and integrally formed on the side of a pickup gear (notched gear) 32 which has no teeth on the side thereof opposed to a gear 31. The pickup gear 32 is urged by an unillustrated urging means in the counterclockwise direction (the direction of the arrow f in FIG. 2), and the turn of the pickup cam 30 is regulated against the urging means by a flapper-type solenoid 33 in this embodiment.

The driving force input from a main motor 34 of the image forming apparatus body A is transmitted to the gear 31 through a gear 35, thereby always rotating the gear 31 in the direction of the arrow g in FIG. 2.

A lifter 36 moves the sheet stack plate 25 of the cassette 8 up and down, and is provided integrally with a ratchet gear 37 at one end thereof.

A lift gear (notched gear) 38, which is placed opposed to the gear 31 and is partially toothless, has a coaxial lift cam 39. A feed pawl 40 is pivoted about a shaft 41 by the rotation of the lift cam 39, and furthermore, the ratchet gear 37 is fed progressively step by step by using the backstop function of a lock pawl 42, whereby the lifter 36 is lifted and the sheets S in the cassette 8 are also lifted up.

In FIG. 2, a lifter trigger lever 43 is pivotally supported by the shaft 28 integrally formed with the feed frame 27, and urged by a spring 44 in the clockwise direction (the direction of the arrow h in FIG. 2). One end of the lifter trigger lever 43 functions as a member for regulating the rotation of the lift gear 38 integrally formed with the lift cam 39, and the other end thereof is so placed as to contact with the pickup roller shaft 9*a* when the pickup roller 9 descends to a predetermined position. In other words, when the pickup roller shaft 9*a* descends to the predetermined position, a regulating section of the lifter trigger lever 43 at the other end frees the left cam 39 from the rotation regulation, the lift cam 39 is thereby rotated, and the feed pawl 40 is pivoted, whereby the lifter 36 is lifted.

When the uppermost sheet plane of the sheets S lifts in correlation to the lift of the lifter 36, the pickup roller 9 in contact with the sheet plane also lifts, the lifter trigger lever 43 turns in the clockwise direction (the direction of the arrow h in FIG. 2) and returns again to such a position to regulate the rotation of the lift cam 39. Repetition of these operations keeps the height of the uppermost plane of the sheets S in the cassette 8 almost constant.

As a result, the apparatus is made ready to feed the sheets S. After that, the pickup cam 30 is rotated by exciting the flapper solenoid 33 in response to a feed start signal, the lift lever 29 rocks, and the pickup roller shaft 9*a* descends, whereby the pickup roller 9 is brought into contact with the sheet S and allowed to feed out the sheets S.

The pickup roller 9 is in contact with the plane of the sheet S only in a time determined by the shape and angular velocity of the pickup cam 30, and then, separates from the sheet plane and moves up. During this time, the feed roller 10 and the retard roller 11 are started to rotate by a feed motor 67 (see FIG. 12), and the sheets S stacked in the cassette 8 are thereby separated and fed one by one. The rotation of the feed roller 10 is controlled by a feed roller clutch 68 (see FIG. 12) interposed between the feed roller 10 and the feed motor 67, and the rotation of the pickup roller 9 is also controlled by the feed roller clutch 68.

When the plane of the sheets S descends after a number of sheets are fed, one end of the lifter trigger lever 43 is pushed up by the pickup roller shaft 9*a*, the lift cam 39 is released from the rotation regulating member, and the ratchet gear 37 is turned by the feed pawl 40, whereby the lifter 36 is raised and the sheet plane returns to the initial position.

The height of the sheet plane is kept almost constant by operating these operations. Since the pickup roller 9 is allowed by these operations to contact with the sheet plane only when delivering the sheets S from the cassette 8 and to be separate from the sheet plane at all other times, it is possible to prevent double feeding of the sheets S by making the most of the double feeding preventing capability of the feed roller 10 and the retard roller 11.

Next, the action of the feed roller 10 and the retard roller 11 will be described with reference to FIGS. 3 and 4.

FIG. 3 is a partially detailed view of a feeding device using the retard separation method. Referring to FIG. 3, when more than two sheets jam between the feed roller 10 and the retard roller 11, a one-way bearing 45 for preventing reverse rotation of the drive gear prevents the second sheet from being fed in the eject direction by pulling the first sheet out. A driving pulley 46 rotates the feed roller shaft 10*a*, a gear 47 receives the rotation torque from the driving motor 34 (see FIG. 2) in the apparatus body, and a timing belt 48 transmits the rotation torque of the same direction as that of the feed roller 10, to the retard roller 11.

Numerals 49, 51 and 52 respectively denote a pulley for rotating a driving shaft 50 of the retard roller 11, a torque limiter, and a coupling for rotating the retard roller 11. Furthermore, a press arm 53 applies pressure to the retard roller 11 and gives the sheet feeding force between the feed roller 10 and the retard roller 11, and a press roller 54 is mounted at the leading end of the press arm 53. The pressure is transmitted to the retard roller 11 through a shaft 57 by giving the torque of the direction of the arrow T to a retard pressure control arm 56 from a coil spring 55.

Numerals 58 and 59 respectively denote a retard roller bearing, and a retard roller shaft which penetrates through the retard roller 11 and has the coupling 52 at the end thereof.

The sheet separating operation of the separation means having the above-mentioned construction will be described with reference to FIG. 4.

Figure 4A:
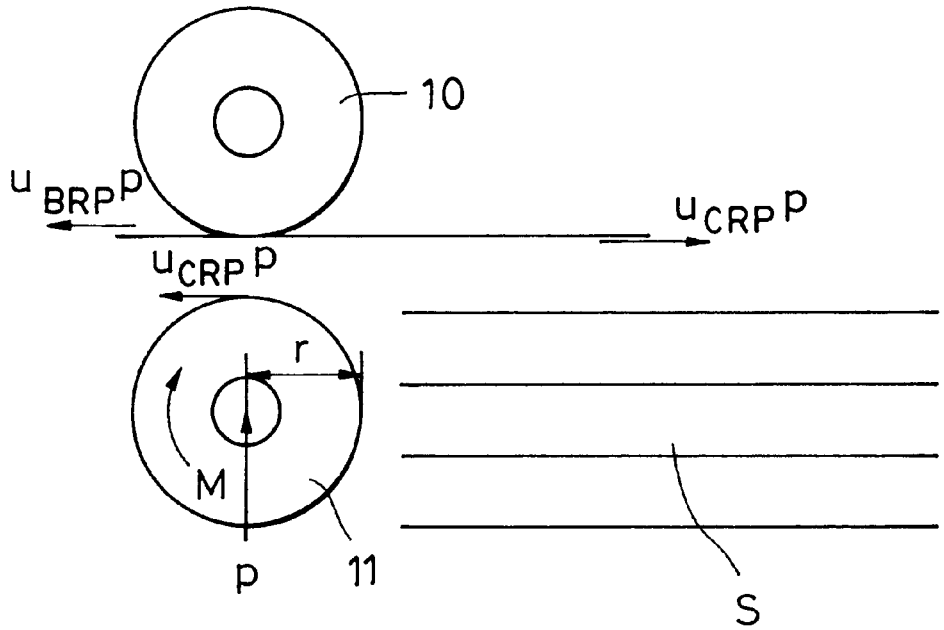
FIGS. 4A and 4B are views explaining the frictional force between the separation means and a plain sheet in a sheet feeding operation.

FIGS. 4A shows a state in which the sheet S supplied by the pickup roller 9 enters a gripping region between the feed roller 10 and the retard roller 11 without causing double feeding, wherein RBRP represents the coefficient of friction between the sheet S and the feed roller 10, $\mu$CRP represents the coefficient of friction between the sheet S and the retard roller 11, and M represents the torque which is given by the torque limiter 51 in order to return the sheet supplied by double feeding. Furthermore, P represents the pressure applied to the retard roller 11 by the spring 55, and r represents the radius of gyration of the retard roller 11.

Referring to FIG. 4A, a condition where the feed roller 10 feeds a normal sheet (a sheet having no flap as distinct from an envelope) without slipping is expressed by the following equation:

$$\mu BRP \cdot P = \mu CRP \cdot P \qquad \text{(Equation 1)}$$

Furthermore, the rotation of the retard roller 11 which slips on the sheet S and the rotation of the retard roller 11 which does not slip on the sheet S are in the following relationship:

$$\mu CRP \cdot P \cdot r \geqq M \qquad \text{(Equation 2)}$$

Therefore, the following equation is derived from Equations 1 and 2:

$$\mu BRP \cdot P \cdot r \geqq M \qquad \text{(Equation 3)}$$

Figure 4B:
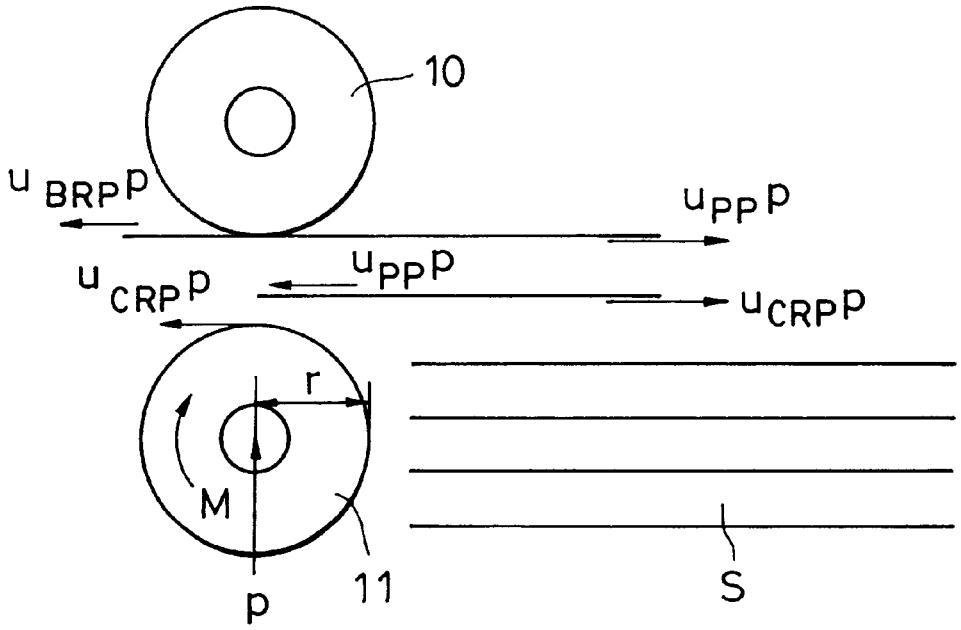

Next, FIG. 4B will be described. FIG. 4B shows the condition in which two sheets S are supplied to the gripping region by the pickup roller 9 and then the unnecessary one is returned by the retard roller 11, wherein $\mu$PP represents the coefficient of friction between the sheets S. A condition where the sheets S are completely separated and fed one by one in FIG. 4B is represented by the following equations:

$$\mu BRP \cdot P > \mu PP \cdot P \quad \text{(Equation 4)}$$

$$\mu CRP \cdot P \geqq \mu PP \cdot P \quad \text{(Equation 5)}$$

Assuming that no slippage occurs between the retard roller 11 and the second sheet S, a condition that the retard roller 11 rotates in the opposite direction to feeding and returns the second sheet S upstream without causing double feeding is expressed by the following equations:

$$\mu CRP \cdot P = \mu PP \cdot P \quad \text{(Equation 6)}$$

$$\mu CRP \cdot P \cdot r < M \quad \text{(Equation 7)}$$

The following equation is derived from Equations 6 and 7:

$$\mu PP \cdot P \cdot r < M \quad \text{(Equation 8)}$$

The aforesaid three Equations 4, 6 and 8 are required to hold simultaneously.

In the retard separation method, the values are set in consideration of durability of the rollers based on the above conditions.

FIGS. 5 shows driving signals for controlling the drive of the pickup roller 9, the feed roller 10 and the retard roller 11.

In FIG. 5, signals A, B and C represent ON signals for a start button, the pickup solenoid and the feed roller clutch, respectively.

[Mechanism for Feeding Envelopes or the Like]

In order to feed sheets each having a flap like an envelope without causing a sheet jam, the sheet feeding apparatus of the present invention is constructed so as to change the number of up-and-down movements of the pickup roller 9 depending on the sheet type set through a sheet type setting means. Next, the construction will be described.

As shown in FIG. 6, the sheet cassette 8 is provided, on the pull-out side thereof, with a setting dial 60 as a component of the sheet type setting means for use in setting the sheet type and size.

Figure 7A:
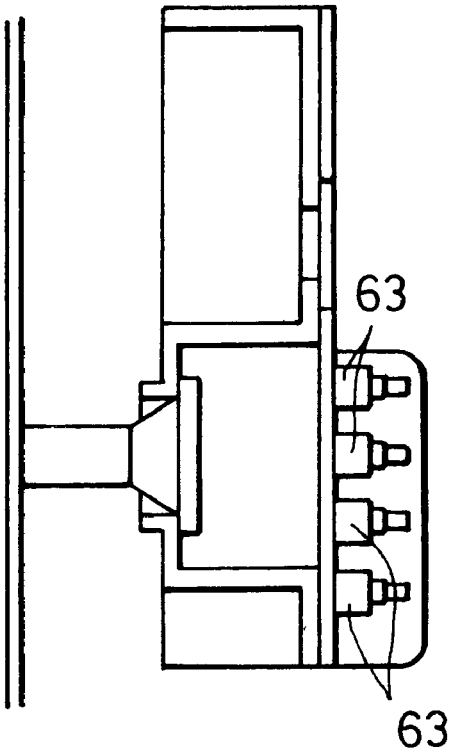
FIGS. 7A and 7B are structural views of a sheet type setting means.
Figure 7B:
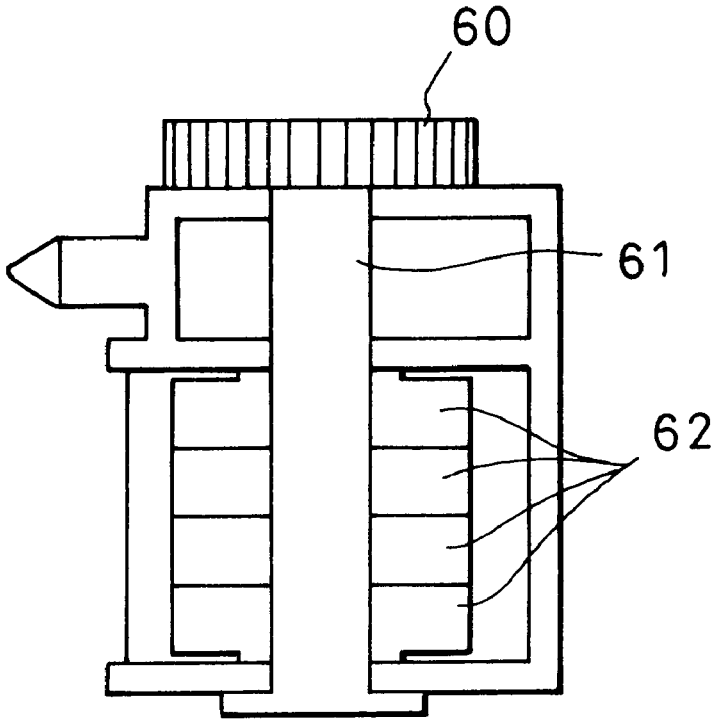
Figure 8A:
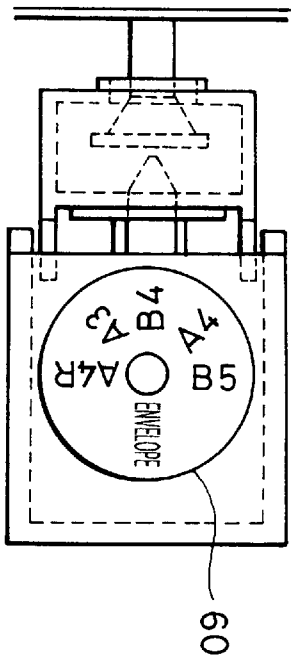
FIGS. 8A to 8C are other structural views of the sheet type setting means.
Figure 8B:
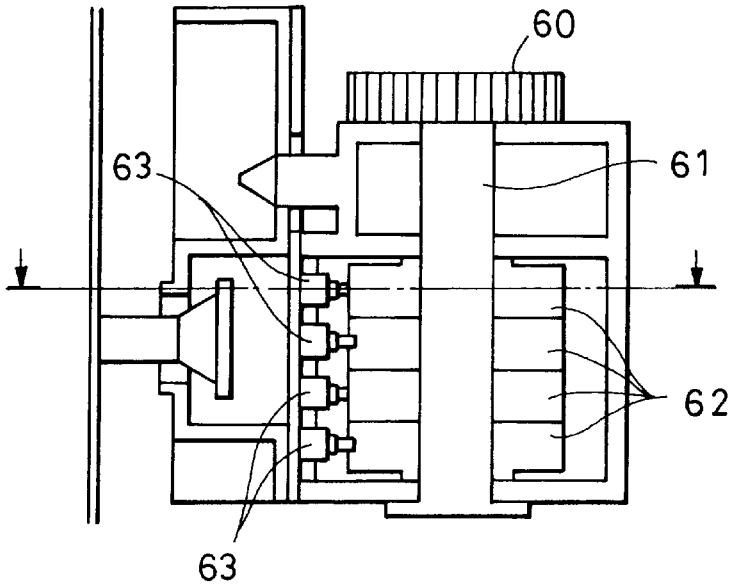

FIGS. 7A and 7B are detailed views of the sheet type and size setting means when the sheet cassette 8 is out of the apparatus body. FIG. 7A shows one part of the setting means which is built into the apparatus body, and FIG. 7B shows the other part built into the sheet cassette 8.

As shown in FIG. 7B, a dial shaft 61 integrally formed with the foregoing setting dial 60 is coaxially provided with switch press disks 62 which are rotatable integrally with the dial 60. Moreover, as shown in FIG. 7A, contact switches 63 are mounted in the apparatus body.

The relationship between the switch press disks 62 and the contact switches 63 will be now described with reference to FIG. 8. FIG. 8A is a plan view of the setting means, FIG. 8B is a front sectional view of the setting means, and FIG. 8C is a partially detailed transverse sectional view of the switch press disk 62 and the contact switch 63 taken along the broken line of FIG. 8B.

Figure 8C:
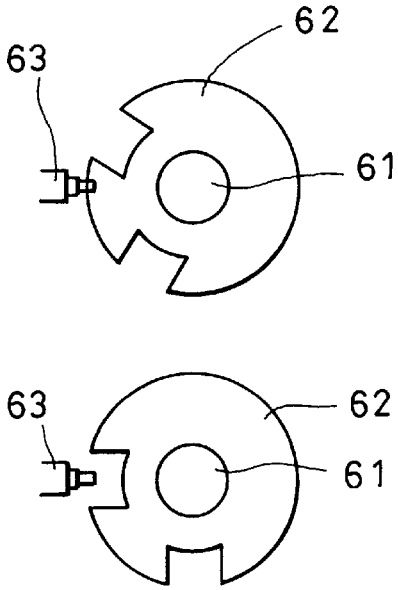
Figure 9:
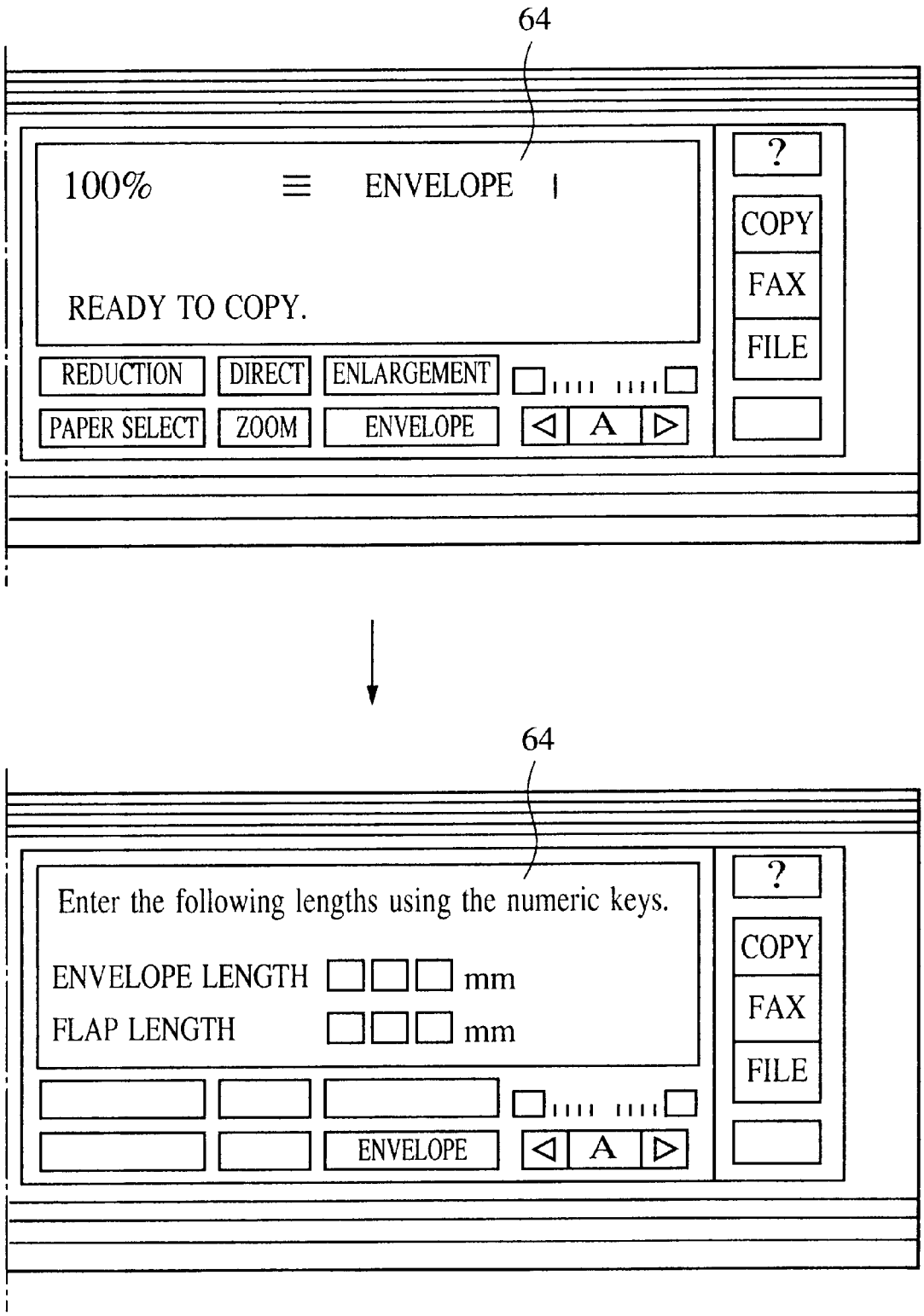
FIG. 9 is an explanatory view of a touch panel.

As shown in FIG. 8C, each of the switch press disks 62 has notched portions, and is not able to press the contact switch 63 at the notched portions. Such switch press disks 62 are combined with one another so that the notch portions thereof are positioned out of alignment in accordance with the sizes indicated on the dial 60. The combination of the ON and OFF signals for the contact switches 63 is thereby changed, and the change is detected by a CPU serving as a control means for controlling the operations of the apparatus.

Since envelopes are available in various sizes, the sheet type in this embodiment is set by the use of the sheet size setting dial 60 as shown in FIG. 8*a*. By this sheet type setting, the sheet length is fixed (at the maximum value) in the sheet feed sequence.

Moreover, in this embodiment, the user is allowed in envelope feeding to enter the length of the envelope and the length of the flap through a touch panel 64 as shown in FIG. 9.

The number of up-and-down movements of the pickup roller 9 is set based on the entered values. The number of up-and-down movements and the feeding time are appropriately set by changing these values. Further, it is needless to say that reentry is necessary when the length value of the flap is larger than that of the envelope.

Figure 10A:
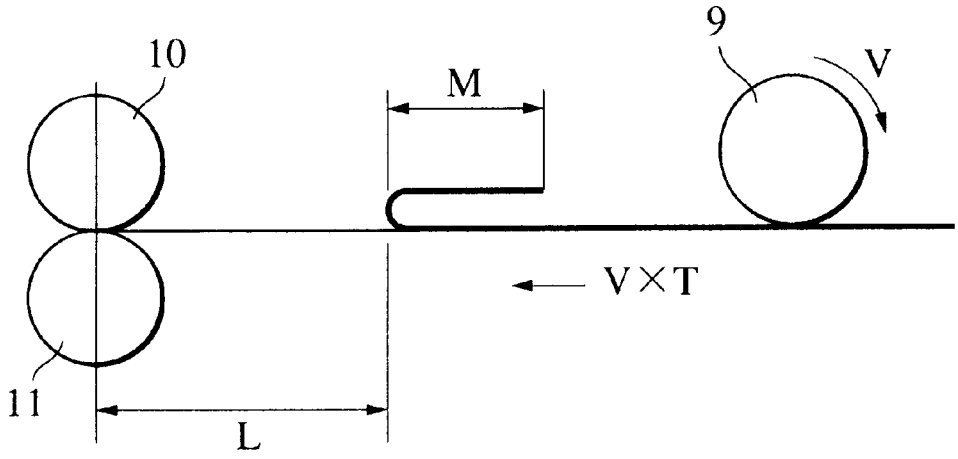
FIGS. 10A and 10B are views explaining the number and time of up-and-down movements of the pickup roller in feeding a sheet having a flap.

Based on the entered length of the envelope flap, the CPU calculates and sets the number N of up-and-down movements of the pickup roller 9 in the following manner:

For example, as shown in FIG. 10A, when the distance between the leading end of the set envelope and the gripping region between the feed roller 10 and the retard roller 11 is taken as L, the length of the envelope flap is taken as M, the sheet feeding velocity of the pickup roller 9 is taken as V, and the time of sheet feeding performed in one operation of the pickup roller 9 in the down position is taken as T, the number N is set as follows:

$$N \geqq \{(L+M)/(V \cdot T)\}+1 \text{(decimals are omitted).}$$

As for the above-mentioned up-and-down movements, referring to FIG. 2, the pickup cam 30 rotates on exciting the flapper solenoid 33 in response to a feed start signal, the lift lever 29 pivots, the pickup roller shaft 9*a* descends, and then, the pickup roller 9 contacts with the sheet S and feeds out the sheet S. After that, the pickup roller 9 is in contact with the sheet plane only for the time determined by the shape and angular velocity of the pickup cam 30, and then, separates and lifts from the sheet plane.

At this time, if the envelopes each having a flap Sa are being fed, after the pickup roller 9 is lifted in the normal operation, the flapper solenoid 33 is excited again after the preset time. Thereby, the pickup cam 30 rotates, the lift lever 29 rocks, the pickup roller shaft 9*a* descends, and the pickup roller 9 is brought into contact with the part of the envelope having no flap to push the envelope.

After that, the pickup roller 9 is in contact with the part of the envelope having no flap only for the time determined by the shape and angular velocity of the pickup cam 30, and then, separates and lifts from the sheet plane. In this way, the envelope feeding time of the pickup roller 9 is longer than the normal sheet feeding time, and the envelope is pushed.

During this time, the drive of the feed roller 10 and the retard roller 11 by the foregoing drive source is continued.

Next, the relationship in feeding force among the rollers will be described with reference to FIG. 11. In FIG. 11B, $\mu$ARP represents the coefficient of friction between the sheet and the pickup roller 9 and W represents the weight of the pickup roller 9. At this time, the rollers are structured so that the following equations hold;

$$\mu CRP \cdot P \cdot r = M \quad \text{(Equation 9)}$$

$$\mu PP \cdot P + \mu ARP \cdot W > \mu CRP \cdot P \quad \text{(Equation 10)}$$

The following equation is derived from the above Equations 9 and 10:

$$\mu PP \cdot P + \mu ARP \cdot P > M \cdot r \quad \text{(Equation 11)}$$

Figure 10B:
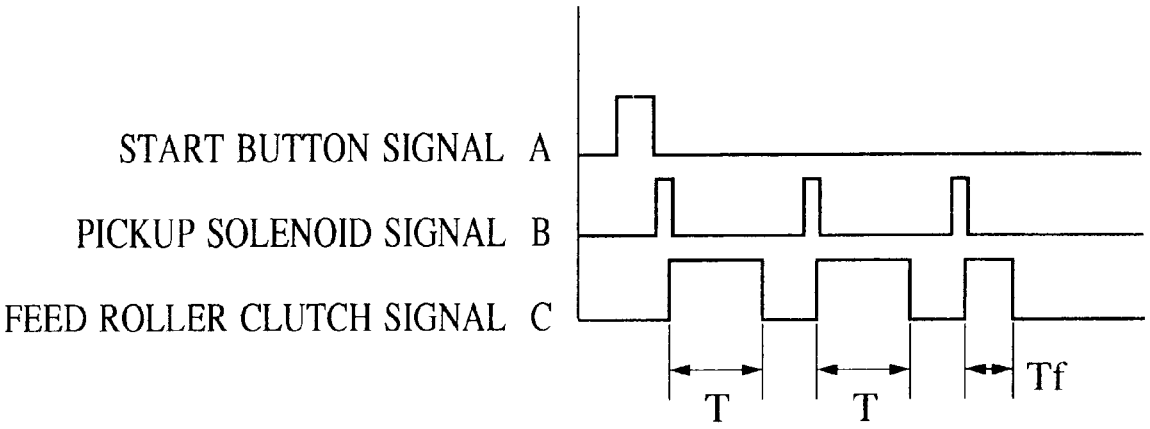

If the above Equation 11 holds, the envelope is intermittently pushed by the pickup roller 9 while the flap of the envelope is gripped between the feed roller 10 and the retard roller 11, which prevents the flap of the envelope from being separated and buckled. FIG. 10B shows driving signals for the components in these operations.

In FIG. 10B, though a setting is made so that the pickup roller 9 is moved up and down three times, in the third down state, the pickup roller 9 is put into the up position after the flap passes through the gripping region between the feed roller 10 and the retard roller 11. Therefore, the time Tf, in which the pickup roller 9 is finally in the down position, is given by the following equation:

$$Tf=\{(L+M)-(N-1)\times V\times T\}/V,\ N=3$$

In FIG. 10B, the time Tf represents the time in which the pickup roller 9 is down and the feed roller clutch 68 is on.

Even if the feed roller 10 and the retard roller 11 are driven while the pickup roller 9 is in the up state (while it is not pushing the envelope), since it takes some time, because of stiffness of the envelope, for the envelope to be buckled by the separation means, the pickup roller 9 is made to move down and feed during the time. However, the up-and-down operation of the pickup roller 9 cannot always be adequately controlled by cams or the like.

Accordingly, in this embodiment, the drive of the feed roller 10 and the retard roller 11 is controlled in synchronization with the up-and-down movements of the pickup roller 9 as shown in FIG. 10B. In other words, when the pickup roller 9 is in the down state and gives the feeding force to the envelope, the feed roller 10 and the retard roller 11 are driven by turning on the feed roller clutch 68, thereby performing the separation and feeding operations. While the pickup roller 9 is in the up state and is not pushing the envelope, the separation and feeding operations of the feed roller 10 and the retard roller 11 are stopped by turning off the feed roller clutch 68.

The configuration of the control means for controlling the drive of the pickup roller 9, the feed roller 10 and the retard roller 11 as mentioned above will be described briefly. As shown in FIG. 12, when a start button 65 is pressed by the user, the CPU 66 receives a signal from a sheet type detection sensor, which is composed of the contact switches 63 and the like, and determines a sheet feed sequence, and a feed motor 67 and the main motor 34 are actuated in response to a signal from the CPU 66. At this time, the feed roller clutch 68 remains in the off state.

According to the above sequence, the flapper solenoid 33 is turned on, the pickup cam 30 is thereby rotated to move the roller holder 26 down. The feed roller clutch 68 is turned on when a preset time has elapsed since the flapper solenoid 33 was turned on, and rotates the rollers so as to perform the aforesaid operations shown in FIG. 10B. Since the rotation of the pickup roller 9 is also controlled by the feed roller clutch 68 in this embodiment, the pickup roller 9, the feed roller 10 and the retard roller 11 are rotated in response to the turn-on of the feed roller clutch 68.

Although the pickup roller 9 is driven in the down state, and stops in the up state, it is effective in preventing double feeding to start the rotation of the pickup roller 9 after the pickup roller 9 is brought into contact with the sheet plane. For this purpose, it is preferable that the feed roller clutch 68 be turned on after the elapse of a required time since the turn-on of the flapper solenoid 33 so that the pickup roller 9 always starts its rotation after contacting with the sheet plane even if the sheet plane descends.

The rotation of the pickup roller 9 may be controlled by its own clutch so as to keep rotating in the up state. In this case, the drive control mechanism is more simple than above.

According to the above-mentioned drive control, the envelope is always pushed by the pickup roller 9 while the flap thereof is positioned in the gripping region between the pair of separation rollers 10 and 11, which makes it possible to reliably prevent the flap of the envelope from being buckled, regardless of the timing of up-and-down movements of the pickup roller 9.

Further, when the pickup roller 9 moves down and feeds the envelopes, the driving time thereof is set longer than that in feeding normal sheets having no flap, whereby the loss of time in feeding envelopes can be minimized.

Next, an envelope cassette, which is able to contain a large number of envelopes, each having a flap, will be described.

Figure 13:
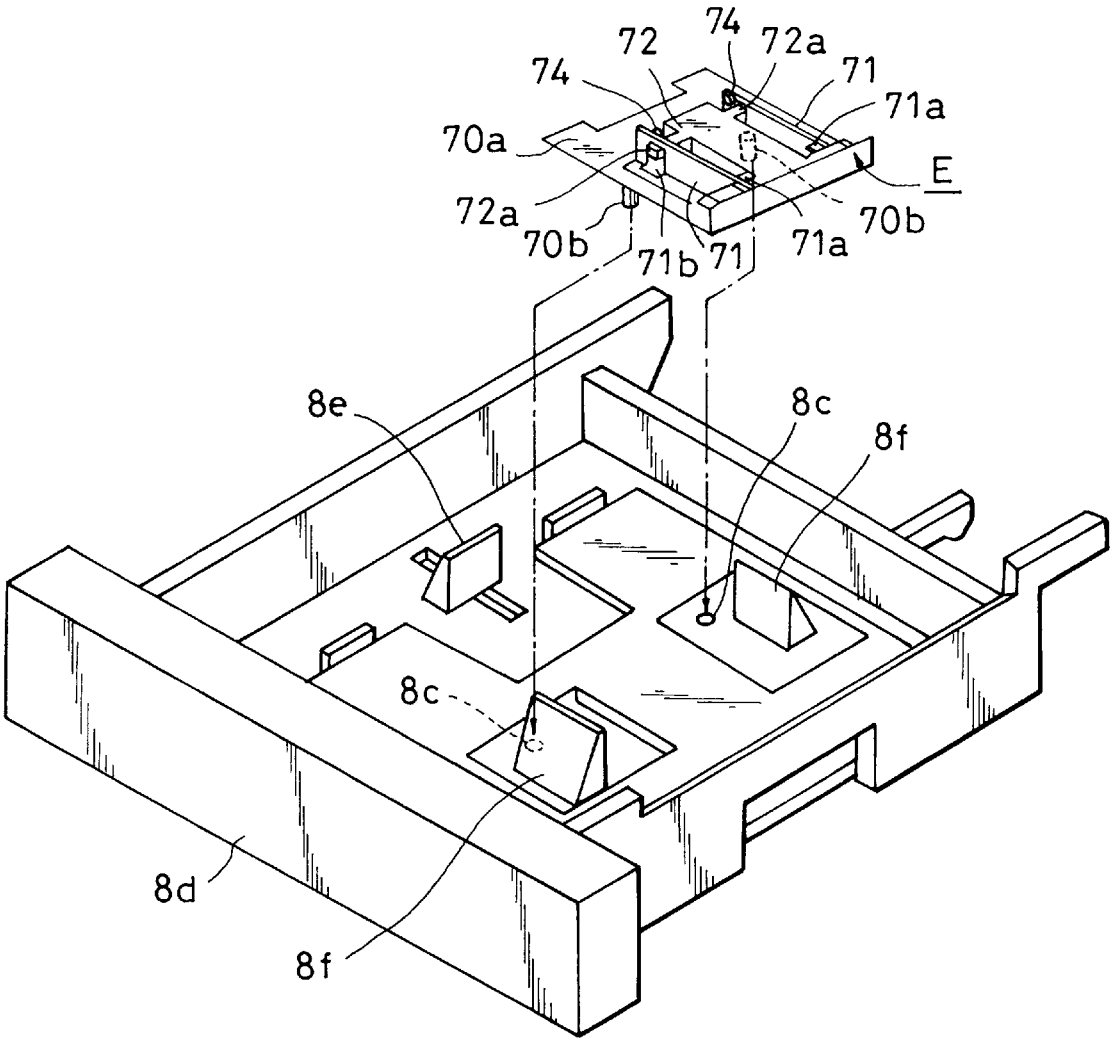
FIG. 13 is a view showing a state in which an envelope cassette capable of restraining bulges of envelopes is attached to and detached from a sheet cassette.
Figure 14:
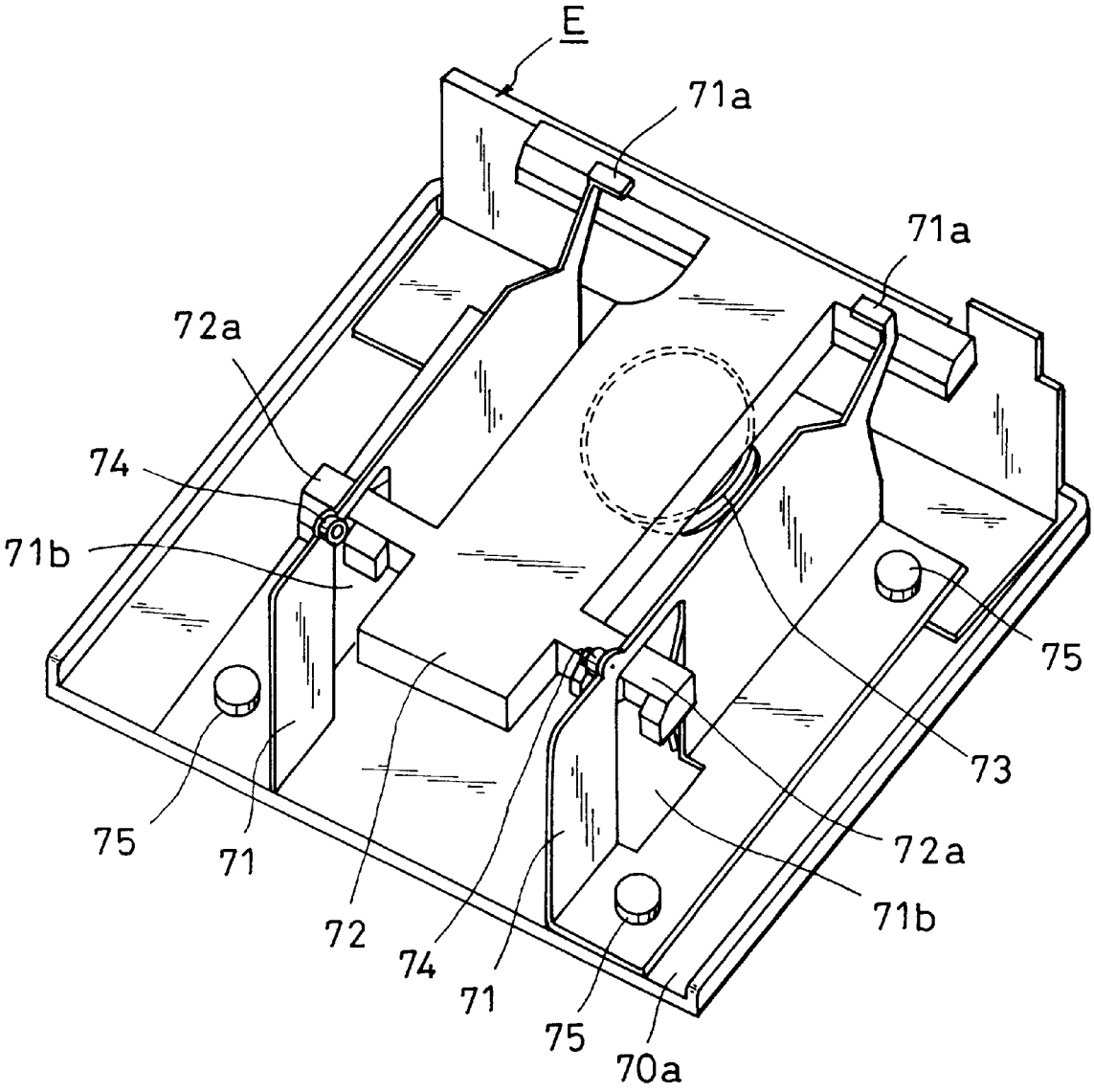
FIG. 14 is a schematic perspective view of the envelope cassette.

FIG. 13 shows a state in which an envelope cassette capable of restraining bulges of envelopes is attached to and detached from the sheet cassette, and FIG. 14 is a schematic perspective view of the envelope cassette.

The sheet cassette 8 is provided with an unillustrated detachable intermediate plate. Below the intermediate plate, a sheet holding section of the sheet cassette 8 has fitting holes 8*c* which are components of a mounting means for detachably mounting a small-sized envelope cassette E therein. Pins 70*b* project from a bottom plate 70*a* of the envelope cassette E at the positions corresponding to the fitting holes 8*c*. The envelope cassette E can be attached to or detached from a cassette body 8*d* by fitting the pins 70 into the fitting holes 8*c* and turnably mounting the envelope cassette E on a hinge portion, or by pulling out the pins 70*b* from the fitting holes 8*c*.

The envelope cassette E accommodates a stack of envelopes, each of which is provided with a flap or is apt to bulge, and is used in supplying the envelopes to the image forming means and printing the names of addressees and the like thereon.

The envelope cassette E is constructed as shown in FIG. 14. Referring to FIG. 14, side regulating plates 71 regulate the widthwise edges of the envelopes, and the positions thereof are adjustable in accordance with various widths of envelopes in an unillustrated manner. When the envelope cassette E is mounted on the sheet cassette 8, a rear end regulating member 8*e* of the sheet cassette 8 doubles as a member for regulating the rear ends of the envelopes in the feeding direction.

An intermediate plate 72 is attached between the side regulating plates 71, supported and pushed up only by a spring 73 mounted on the bottom plate 70*a*. Thereby, the intermediate plate 72 is always pushed upward, and the envelopes stacked thereon are in contact with claws 71*a* formed on the side regulating plates 71 and made ready to be delivered by the pickup roller 9.

The side regulating plates 71 are respectively provided with presser members 74 for restraining the bulging of the stacked envelopes and the unfolding of the flaps. The presser members 74 are turnably supported by the side regulating plates 71 and positioned opposed to each other.

The intermediate plate 72 is further provided with retaining projections 72*a*, which are respectively engaged with guide grooves 71*b* formed on the side regulating plates 71. The intermediate plate 72 is thereby prevented from lifting above a predetermined position.

Numeral 8*f* in FIG. 13 denotes sheet side regulating plates in the cassette body, and numeral 75 in FIG. 14 denote screws for fixing the side regulating plates 71 which are slid in accordance with the envelope size.

The mounting of such an envelope cassette E makes it possible to automatically and reliably feed a stack of envelopes each of which has a flap and is apt to bulge.

Another embodiment of the present invention will be now described.

Figure 15:
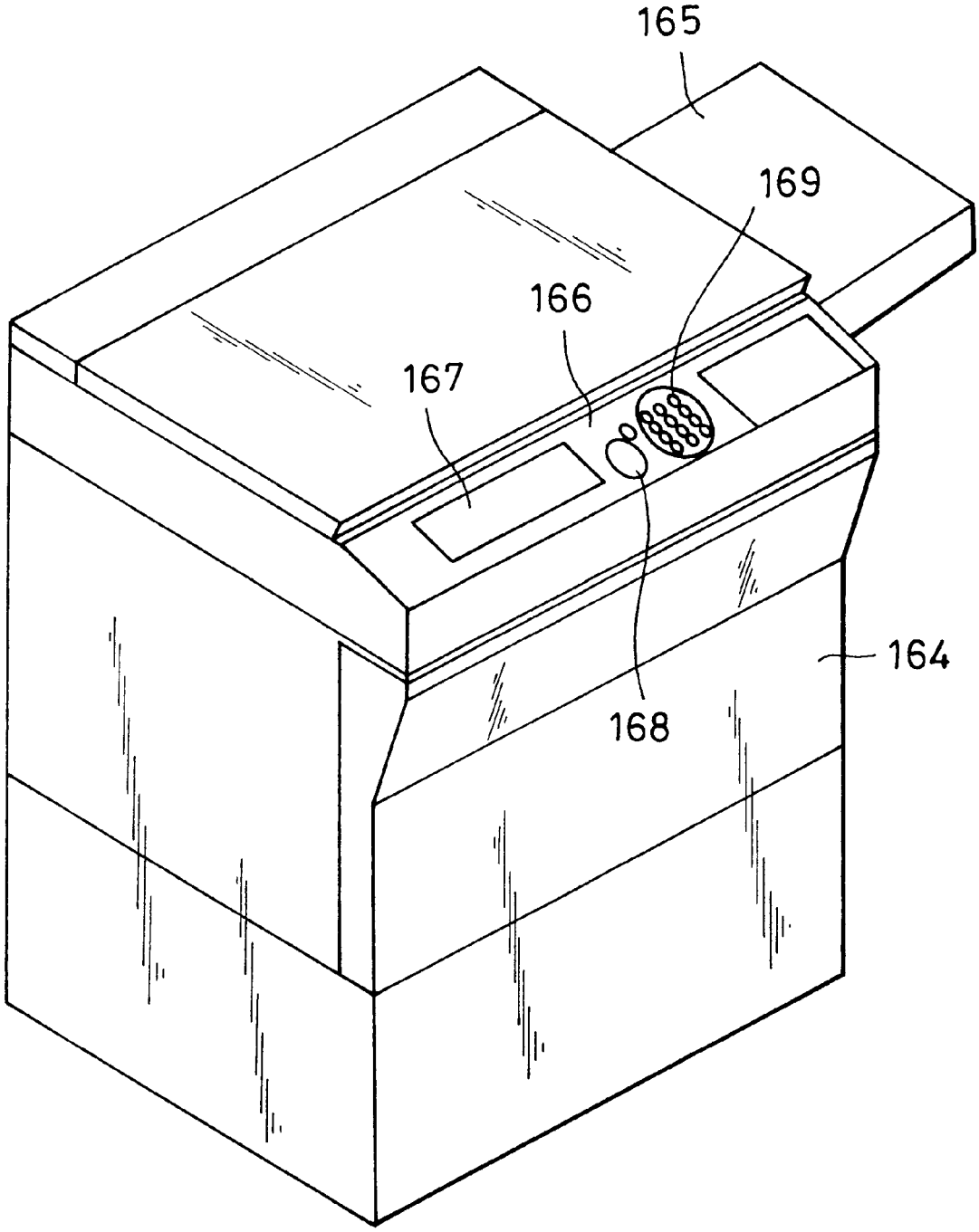
FIG. 15 is an external view of a complex copying machine.

FIG. 15 is an external view of a complex copying machine. Referring to FIG. 15, the complex copying machine mainly comprises a main body 164, a manual supply unit 165, and a control section 166 including an LCD touch panel 167, a start button 168 and numeric keys 169. The LCD panel 167 is the same as in the aforesaid embodiment.

Next, the motion of a pickup roller 109 mounted in the manual supply unit 165 will be described.

Figure 16:
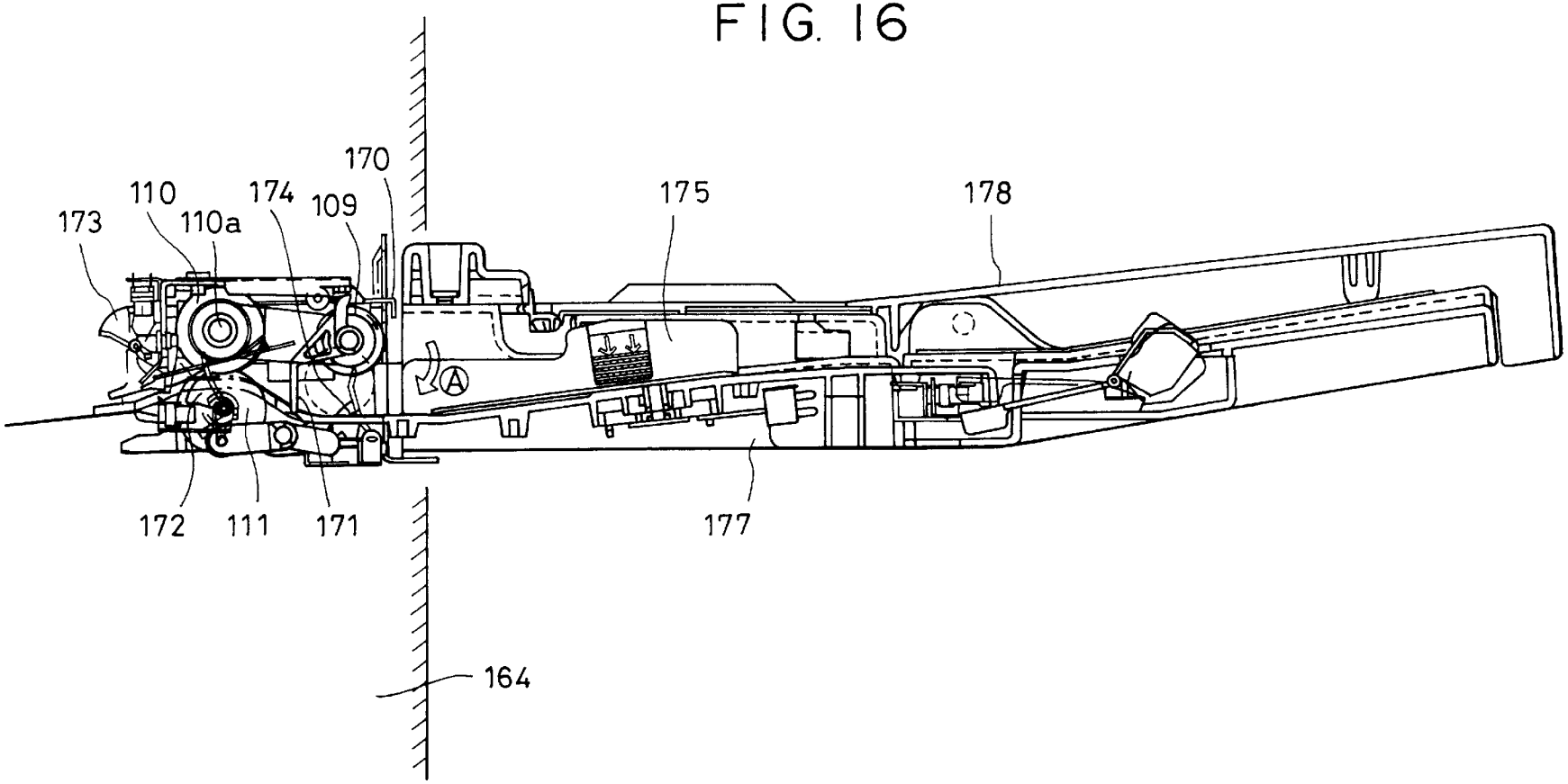
FIG. 16 is a central sectional view of a manual feed unit.
Figure 17:
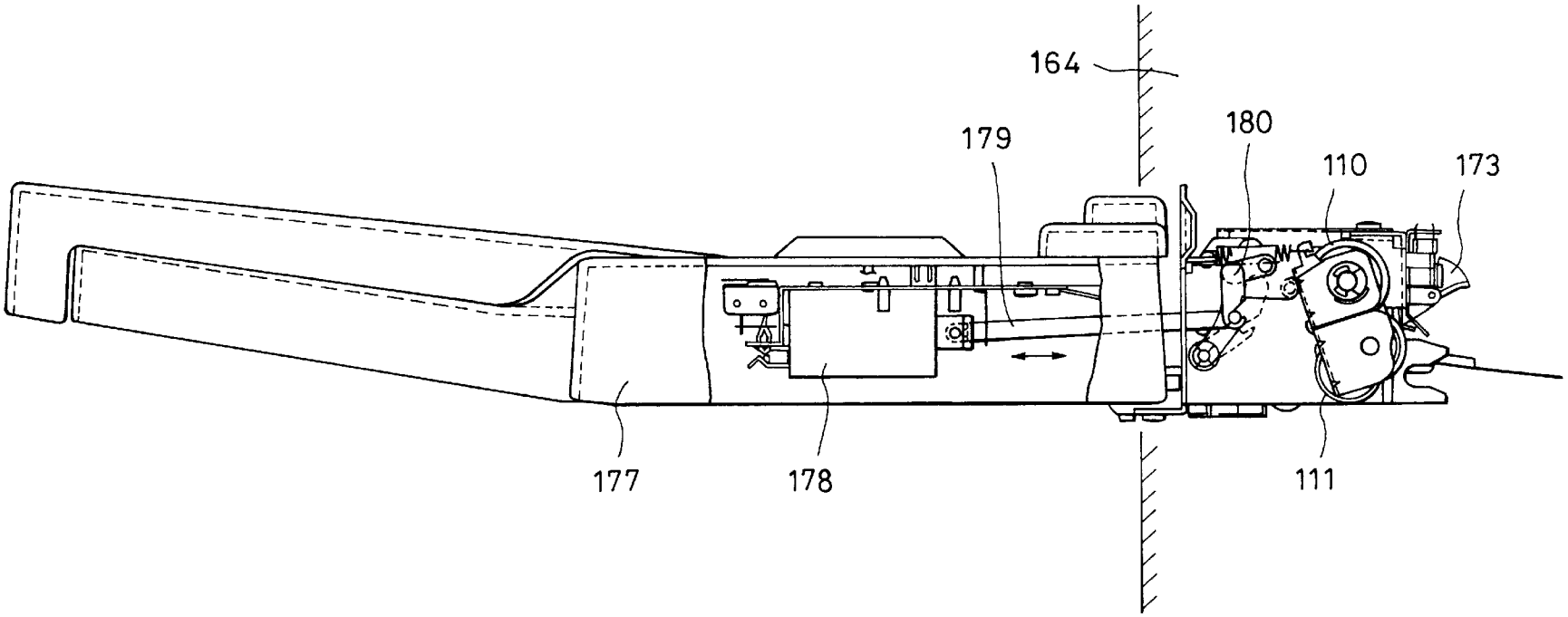
FIG. 17 is a rear view of the manual feed unit.

FIG. 16 is a central sectional view of the manual supply unit 165, and FIG. 17 is a rear view thereof. In these figures, a support plate 170 supports the pickup roller 109, a sheet stopper 171 functions as a stopper for use in setting the sheets, a leading end detection sensor 172 detects the passage of the leading end of the sheet through a gripping region between a feed roller 110 and a retard roller 111, a rear end detection sensor 173 detects the passage of the rear end of the sheet, and a loading sensor 174 detects the loading of sheets in a tray.

Moreover, numerals 175, 176 and 177 respectively denote side regulating plates 175 for regulating both widthwise sides of the sheets S, a tray cover, and a tray body. A latch-type solenoid 178 pulls a core in and out, particularly, by feeding opposite currents therethrough, a link 179 transmits the motion of the core in the solenoid 178, and a pickup arm 180 moves the support plate 170 for the pickup roller 109 up and down in correlation to the motion of the link 179.

According to the above-mentioned construction, in a normal sheet feeding mode, when the press of the start button 168 by the user is detected as a signal, current is applied to the solenoid 178, thereby pulling the core out. Then, the link 179 is thereby moved in the rightward direction in FIG. 17, and the pickup arm 180 is turned and shifted to a position shown by a broken line, whereby a projecting section projecting from the leading end of the arm 180 toward the unillustrated opposite side of the drawing is separated from the support plate 170 (see FIG. 16). Then, the support plate 170 mounted pivotally about a feed roller shaft 110*a* is pivoted by its own weight together with the pickup roller 109 in the direction of the arrow A in FIG. 16, and the pickup roller 109 is brought into contact with the sheet plane. The feed clutch is thereby turned on, and the rollers are rotated in the feeding direction.

When the leading end detection sensor 172 is turned on, an opposite current to that in feeding is applied to the solenoid 178, and the core is thereby pulled in. The link 179 is moved in the leftward direction in FIG. 17, the pickup arm 180 is turned and returned to the position shown by the solid line. Then, the projecting section at the leading end of the arm 180, which projects toward the unillustrated opposite side of the drawing paper, pushes up the support plate 170 to pivot about the feed roller shaft 110*a*, and the pickup roller 109 separates from the sheet plane.

The three rollers are made to continue rotating until the signal from the leading end detection sensor 172 is turned off. Furthermore, when a lot of sheets are supplied, the second sheet is started to be feed on the turn-off of the signal from the sheet rear end detection sensor 173. Subsequently, the aforesaid operations are repeated.

Figure 18A:
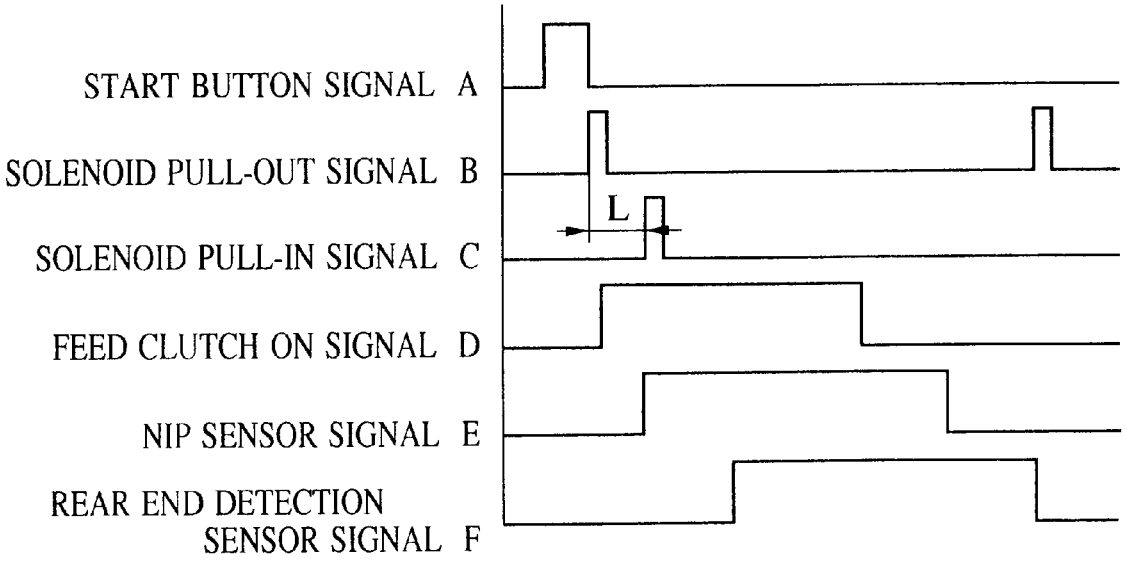
FIGS. 18A and 18B are charts explaining signals for use in moving a pickup roller up and down.

FIG. 18A is a chart showing the flow of signals for these operations. In FIG. 18A, A represents a start button signal, B represents a pickup solenoid pull-out signal, C represents a pickup solenoid pull-in signal, D represents an ON signal for the feed clutch, E represents a signal from the leading end detection sensor 172, and F represents a signal from the sheet rear end detection sensor 173. L in FIG. 18A represents the time in which the pickup roller 109 feeds the sheet in contact with the sheet plane, and this value L is kept constant in normal sheet feeding.

Next, the operation of feeding envelopes each having a flap will be described. In this embodiment, the user selects an envelope feeding mode by using the touch panel 167 in feeding the envelopes.

At the selection of the envelope feeding mode, the user operates the numeric keys according to indicated directions, and enters the lengths of the flap and the envelope. The feeding time of the pickup roller 109 is set in accordance with the entered value, and can be appropriately set by changing this value (time setting means). Further, it is needless to say that reentry is needed when the entered length value of the flap is larger than that of the envelope.

After the start button 168 is pressed and feeding is started, operations, which are the same as in the above embodiment except that the contact time of the pickup roller 109 with the sheet plane is different, are performed.

Figure 18B:
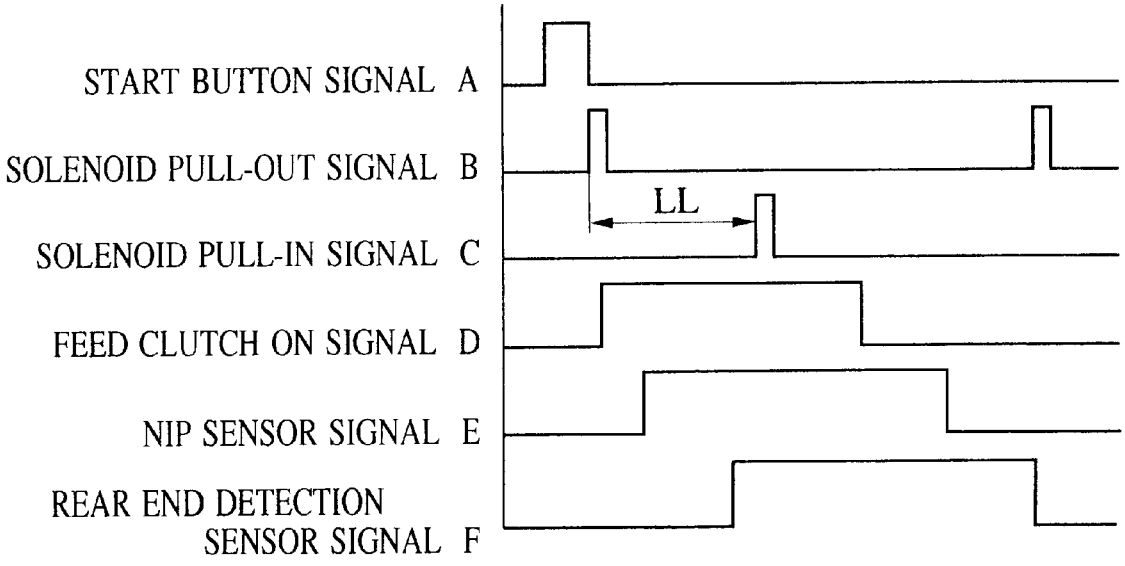

FIG. 18B explains the operations. LL in FIG. 18B represents the time in which the pickup roller 109 is feeding sheets in contact with the sheet plane. When the length entered by the user through the touch panel 167 is taken as MM and the feeding speed is taken as V, the time LL equals to MM/V. In other words, the user is allowed to freely set the feeding time by using the touch panel 167.

As described in this embodiment, even if the envelope feeding time of the pickup roller 109 is made longer than the normal sheet feeding time in accordance with the value appropriately set by the user, since the feeding force is increased, in the same manner as in the aforesaid embodiment, while the flap is being gripped by the separation means, sheet jam or the like is prevented.

Although the image forming apparatus is given as an example of the apparatus using the sheet feeding apparatus in the above embodiments, the apparatus for performing sheet feeding may be applied not only to the image forming apparatus, but to, for example, an image reading apparatus for automatically feeding sheets and reading images thereon.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet feeding apparatus comprising:

sheet support means for supporting sheets of an identifiable type;

pickup rotating means for feeding out a sheet through a distance from the sheets supported by said sheet support means;

separation means for sequentially separating the sheet fed out by said pickup rotating means, said separation means having feed rotating means for rotating in a direction to advance the sheet and retard rotating means, located opposed to said feed rotating means, for rotating in a direction to return surplus sheets to said sheet support means; and control means for controlling the distance the sheet is fed by said pickup rotating means, said control means controlling the distance in accordance with the type of sheet to be fed.

2. A sheet feeding apparatus according to claim 1, wherein said control means controls the distance the sheet is fed by changing the duration of rotation of said pickup rotating means in contact with the sheet to be fed.

3. A sheet feeding apparatus according to claim 2, wherein the identifiable type of sheets are sheets having a flap, and said control means sets the duration of rotation of said pickup rotating means so that said pickup rotating means continues rotating until the flap of the sheet passes between the feed rotating means and the retard rotating means.

4. A sheet feeding apparatus according to claim 1, further comprising:

pickup shift means for shifting said pickup rotating means between a position in contact with the sheet for feeding out the sheet through a distance and a position out of contact with the sheet, wherein said control means controls said pickup rotating means so as to repeat an operation of contacting with and separating from the sheet to be fed out, and said control means controls a distance the sheet is fed by changing the number of times that said pickup rotating means contacts with the sheet.

5. A sheet feeding apparatus according to claim 4, wherein the identifiable type of sheets are sheets having a flap, and said control means controls said pickup rotating means so that said pickup rotating means repeats the contacting and separating operations with respect to the sheet until the flap of the sheet passes between the feed rotating means and the retard rotating means.

6. A sheet feeding apparatus according to claim 4, wherein said pickup shift means has a rotatable cam whereby said pickup rotating means performs one contacting and separation operation with respect to the sheet for each rotation of said cam.

7. A sheet feeding apparatus according to claim 1, wherein said control means has input means for entering a signal identifying the sheet type, and controls the distance the sheet is fed by said pickup rotating means according to the signal from said input means.

8. A sheet feeding apparatus comprising:

sheet support means for supporting sheets of an identifiable type;

pickup rotating means for feeding out a sheet through a distance from the sheets supported by said sheet support means;

separation means for sequentially separating the sheet fed out by said pickup rotating means, said separation means having feed rotating means for rotating in a direction to advance the sheet and retard rotating means, located opposed to said feed rotating means, for rotating in a direction to return surplus sheets to said sheet support means;

pickup shift means for shifting said pickup rotating means between a position in contact with the sheet for feeding out the sheet and a position out of contact with the sheet;

pickup control means for controlling said pickup shift means so that said pickup rotating means repeats a contacting and separating operation with respect to the sheet to be delivered; and drive control means for transmitting a drive force to said separation means when said pickup rotating means is feeding out the sheet in contact therewith, during the repetition of the contacting and separating operation thereof with respect to the sheet to be fed, and interrupting the transmission of the drive force to said separation means when said pickup rotating means is apart from the sheet.

9. A sheet feeding apparatus according to claim 8, wherein said pickup control means controls in accordance with the sheet type the number of times that said pickup rotating means contacts with and separates from the sheet.

10. A sheet feeding apparatus according to claim 9, wherein the identifiable type of sheet is a sheet having a flap, and said control means controls said pickup rotating means to repeat the contacting and separating operation until the sheet supported by said sheet support means is fed out and the flap of the sheet passes between the feed rotating means and the retard rotating means.

11. A sheet feeding apparatus according to claim 10, wherein the number N of shifts of said pickup rotating means is set as follows:

$$N \geq \{(L+M)/(V \times T)\}+1$$

where the distance between the leading end of the sheet supported by said sheet support means and said feed rotating means is taken as L, the length of the flap of the sheet is taken as M, the sheet feeding velocity of said pickup rotating means is taken as V, and the time of sheet feeding performed in one contact of said pickup rotating means with the sheet is taken as T (each of L, M, V and T having decimals omitted).

12. A sheet feeding apparatus according to claim 11, further comprising:

input means for entering the length of the flap of the sheet into said pickup control means.

13. A sheet feeding apparatus according to claim 8, wherein said pickup shift means has a rotatable cam, whereby said pickup rotating means performs one contacting and separating operation with respect to the sheet for each rotation of said cam.

14. A sheet feeding apparatus according to claim 8, wherein the identifiable type of sheets are sheets having a flap, and said sheet support means is provided with presser means for pressing the flap.

15. An image forming apparatus comprising:

sheet support means for supporting sheets of an identifiable type;

pickup rotating means for feeding out a sheet through a distance from the sheets supported by said sheet support means;

separation means for sequentially separating the sheet fed out by said pickup rotating means, said separation means having feed rotating means for rotating in a direction to advance the sheet and retard rotating means, located opposed to said feed rotating means, for rotating in a direction to return surplus sheets to said sheet support means;

control means for controlling the distance the sheet is fed by said pickup rotating means, said control means controlling the distance in accordance with the type of sheet to be fed; and image forming means for forming an image on the sheet separated and fed by said separation means.

16. An image forming apparatus comprising:

sheet support means for supporting sheets of an identifiable type;

pickup rotating means for feeding out a sheet through a distance from the sheets supported by said sheet support means;

separation means for sequentially separating the sheet fed out by said pickup rotating means, said separation means having feed rotating means for rotating in a direction to advance the sheet and retard rotating means, located opposed to said feed rotating means, for rotating in a direction to return surplus sheets to said sheet support means;

pickup shift means for shifting said pickup rotating means between a position in contact with the sheet for feeding out the sheet and a position out of contact with the sheet;

pickup control means for controlling said pickup shift means so that said pickup rotating means repeats a contacting and separating operation with respect to the sheet to be fed out;

drive control means for transmitting a drive force to said separation means when said pickup rotating means is feeding out the sheet in contact therewith, during the repetition of the contacting and separating operation thereof with respect to the sheet to be fed, and interrupting the transmission of the drive force to said separation means when said pickup rotating means is apart from the sheet; and image forming means for forming an image on the sheet separated and fed by said separation means.

* * * * *

UNITED STATES PATENT AND TRADEMARK OFFICE

CERTIFICATE OF CORRECTION

PATENT NO. : 6,042,099

DATED : March 28, 2000

INVENTOR(S): HIROAKI TAKAGISHI

It is certified that error appears in the above-identified patent and that said Letters Patent is hereby corrected as shown below:

COLUMN 6:

Line 38, "RBRP" should read --μBRP--; and

Line 66, "wherein μPP" should read --wherein μPP--.

COLUMN 11:

Line 59, "feed" should read --fed--.

Signed and Sealed this

Twenty-seventh Day of March, 2001

Nicholas P. Godici

*Attest:*

NICHOLAS P. GODICI

*Acting Director of the United States Patent and Trademark Office*

*Attesting Officer*